US005445750A

United States Patent [19]

Chafetz et al.

[11] Patent Number: 5,445,750

[45] Date of Patent: Aug. 29, 1995

[54] LUBRICATING OIL COMPOSITION CONTAINING THE REACTION PRODUCT OF AN ALKENYLSUCCINIMIDE WITH A BIS(HYDROXYAROMATIC) SUBSTITUTED CARBOXYLIC ACID

[75] Inventors: Harry Chafetz, Hyde Park; Christopher S. Liu, Poughkeepsie; Brian L. Papke, Wappingers Falls; Thomas A. Kennedy, New Windsor, all of N.Y.

[73] Assignee: Texaco Inc., White Plains, N.Y.

[21] Appl. No.: 115,838

[22] Filed: Sep. 3, 1993

[51] Int. Cl.[6] ..... C10M 159/12

[52] U.S. Cl. ..... 252/49.6; 252/51.5 A

[58] Field of Search ..... 252/51.5 A, 49.6

[56] References Cited

U.S. PATENT DOCUMENTS

| | | | |
|---|---|---|---|
| 2,568,876 | 9/1951 | White et al. | 106/14 |
| 3,131,150 | 4/1964 | Stuart et al. | 252/34.7 |
| 3,172,892 | 3/1965 | Le Suer et al. | 260/326.5 |
| 3,216,936 | 11/1965 | Le Suer | 252/32.7 |
| 4,048,080 | 9/1977 | Lee et al. | 252/51.5 A |
| 4,338,205 | 7/1982 | Wisotsky | 252/32.5 |
| 4,482,464 | 11/1984 | Karol et al. | 252/51.5 A |
| 4,617,137 | 10/1986 | Plavac | 252/51.5 A |
| 4,636,322 | 1/1987 | Nalesnik | 252/51.5 A |
| 4,663,064 | 5/1987 | Nalesnik et al. | 252/51.5 A |
| 4,670,173 | 6/1987 | Hayashi et al. | 252/51.5 A |
| 4,699,724 | 10/1987 | Nalesnik et al. | 252/51.5 A |
| 4,713,189 | 12/1987 | Nalesnik et al. | 252/51.5 A |
| 5,102,570 | 4/1992 | Migdal et al. | 252/51.5 A |
| 5,221,491 | 6/1993 | Roper et al. | 252/51.5 A |
| 5,235,067 | 8/1993 | Allen et al. | 252/51.5 A |

*Primary Examiner*—Jerry D. Johnson
*Attorney, Agent, or Firm*—George J. Darsa

[57] ABSTRACT

A lubricating oil composition comprising (1) a major portion of a lubricating oil of a base oil viscosity, and (2) a minor portion of an antioxidant-dispersant lubricating additive prepared by the process comprising:

(a) reacting a polyethyleneamine with an alkenylsuccinic acid anhydride to form a mono- and/or bis-alkenylsuccinimide;

(b) adding to said mono-and/or bis-alkenylsuccinimide, a bis(hydroxyaromatic) substituted carboxylic acid and, optionally, another acylating agent to form an acylated mono-and/or bis-alkenylsuccinimide;

(c) recovering said acylated mono-and/or bis-alkenylsuccinimide.

8 Claims, No Drawings

LUBRICATING OIL COMPOSITION CONTAINING THE REACTION PRODUCT OF AN ALKENYLSUCCINIMIDE WITH A BIS(HYDROXYAROMATIC) SUBSTITUTED CARBOXYLIC ACID

BACKGROUND OF THE INVENTION

This invention is related to lubricating oil additives, and more particularly to antioxidant-dispersant lubricating oil additives.

It is well known that internal combustion engines operate under a wide range of temperatures including low temperature stop-and-go- service as well as high temperature conditions produced by continuous high speed driving. Stop-and-go driving, particularly during cold, damp weather conditions, leads to the formation of a sludge in the crankcase and in the oil passages of a gasoline or a diesel engine. This sludge seriously limits the ability of the crankcase oil to effectively lubricate the engine. In addition, the sludge with its entrapped water tends to contribute to rust formation in the engine. These problems tend to be aggravated by the manufacturer's lubrication service recommendations which specify extended oil drain intervals.

It is known to employ nitrogen containing dispersants and/or detergents in the formulation of crankcase lubricating oil compositions. Many of the known dispersant/detergent compounds are based on the reaction of an alkenylsuccinic acid or anhydride with an amine or polyamine to produce an alkyl succinimide or an alkenylsuccinimide acid as determined by selected conditions of reaction.

It is also known to chlorinate alkenylsuccinic acid or anhydride prior to the reaction with an amine or polyamine in order to produce a reaction product in which a portion of the amine or polyamine is attached directly to the alkenyl radical of the alkenyl succinic acid or anhydride. The thrust of many of these processes is to produce a product having a relatively high level of nitrogen in order to provide improved dispersancy in a crankcase lubricating oil composition.

With the introduction of four cylinder internal combustion engines which must operate at relatively higher engine speeds or RPM's than conventional 6- and 8-cylinder engines in order to produce the required torque output, it has become increasingly difficult to provide a satisfactory dispersant lubricating oil composition.

Thus, an object of the present invention is to provide a lubricating oil composition having improved dispersancy and antioxidancy.

Another object is to provide a lubricating oil composition which can withstand the stresses imposed by modern internal combustion engines.

DISCLOSURE STATEMENT

U.S. Pat. Nos. 4,713,189 and 4,699,724 disclose a lubricating oil composition having improved dispersancy and Viton seal compatibility. The dispersant being prepared by coupling two mono-alkenyl succinimides with an aldehyde and a phenol,. The resulting coupled succinimide is then acylated with glycolic acid to form a glycolate Mannich phenol coupled mono-alkenyl succinimide.

U.S. Pat. No. 4,636,322 discloses a lubricating oil composition having improved dispersancy and Viton seal compatibility. The dispersant being prepared by coupling partly glycolate succinimides with an aldehyde and a phenol.

U.S. Pat. No. 4,482,464 discloses a lubricating oil composition comprising a major proportion of an oil of lubricating viscosity and a minor dispersant amount of a hydrocarbyl- substituted mono-and bis-succinimide compound having branched hydroxylacyl radicals.

U.S. Pat. No. 4,699,724 discloses a lubricating oil composition having improved dispersancy and Viton seal compatibility. The dispersant being prepared by coupling two mono-alkenylsuccinimides with an aldehyde and phenol. The resulting coupled succinimide is then acylated with glycolic acid to form a glycolated Mannich phenol coupled mono-alkenylsuccinimide. U.S. Pat. No. 4,636,322 also discloses polyisobutenylsuccinimide dispersants.

U.S. Pat. No. 5,102,570 discloses the polyisobutenylsuccinimide acylated Mannich hydroxyaromatic-amine coupled mono- and/or bis-alkenylsuccinimide dispersant described in Example 2 of the Examples.

U.S. Pat. Nos. 3,172,892 and 4,048,080 disclose alkenylsuccinimides formed from the reaction of an alkyne succinic anhydride and an alkylene polyamine and their use as dispersants in a lubricating oil composition.

U.S. Pat. No. 2,568,876 discloses reaction products prepared by reacting a monocarboxylic acid with a polyalkylene polyamine followed by a reaction of the intermediate product with an alkenyl succinic acid anhydride.

U.S. Pat. No. 3,216,936 discloses a process for preparing an aliphatic amine lubricant additive which involves reacting an alkylene amine, a polymer substituted succinic acid and an aliphatic monocarboxylic acid.

U.S. Pat. No. 3,131,150 discloses lubricating oil compositions containing dispersant-detergent mono- and dialkyl-succinimides or bis(alkenylsuccinimides).

Netherlands Patent 7,509,289 discloses the reaction product of an alkenyl succinic anhydride and an aminoalcohol, namely, a tris(hydroxymethyl) aminomethane.

U.S. patent application, Ser. No. 06/334,774, filed on Dec. 28, 1981, now U.S. Pat. No. 4,579,674 discloses a hydrocarbyl-substituted succinimide dispersant having a secondary hydroxy-substituted diamine or polyamine segment and a lubricating oil composition containing same.

U.S. Pat. No. 4,338,205 discloses alkenyl succinimide and borated alkenyl succinimide dispersants for a lubricating oil with impaired diesel dispersancy in which the dispersant is treated with an oil-soluble strong acid.

The disclosures of U.S. Pat. Nos. 3,172,892; 4,636,322; 4,713,189; 5,102,570; and 4,699,724; and of U.S. patent application, Ser. No. 06/334,774, now U.S. Pat. No. 4,579,674 and are incorporated herein by reference.

The object of this invention is to provide a lubricating oil composition having superior dispersancy and antioxidant properties over the above cited prior art.

SUMMARY OF THE INVENTION

This invention provides a lubricating oil composition comprising (1) a major portion of a lubricating oil of a base oil viscosity and (2) a minor portion of an antioxidant-dispersant lubricating additive prepared by the process comprising;

(a) reacting a polyethyleneamine with an alkenylsuccinic acid anhydride to form a mono-and/or bis-alkenylsuccinimide;

(b) adding to said mono-and/or bis-alkenyl-succinimide, a bis(hydroxyaromatic) substituted carboxylic acid and, optionally, another acylating agent to form an acylated mono-and/or bis-alkenyl succinimide; and (c) recovering said acylated mono-and/or bis-alkenylsuccinimide.

DETAILED DESCRIPTION

In carrying out the present process, the reactants are step wise reacted with a long chain hydrocarbyl substituted dicarboxylic acid anhydride containing residual unsaturation in a "one pot reaction". The long chain hydrocarbon group is a ($C_2$-$C_{10}$) polymer, e.g., a ($C_2$-$C_5$) monoolefin, the polymer having a number average molecular weight (Mn) of about 500 to about 10,000.

Preferred olefin polymers for reaction with the unsaturated dicarboxylic acid anhydride or ester are polymers comprising a major molar amount of ($C_2$-$C_{10}$) polymer, e.g., a ($C_2$-$C_5$) monoolefin.

Such olefins include ethylene, propylene, butylene, isobutylene, pentenes, 1-octene, styrene, etc. The polymers can be homopolymers such as polyisobutylene, as well as copolymers of two or more of such olefins such as copolymers of: ethylene and propylene, butylene and isobutylene, propylene and isobutylene, etc. Other copolymers include those in which a minor molar amount of the copolymer monomers e.g., 1 to 10 mole % is a ($C_4$-$C_{10}$) non-conjugated diolefin, e.g., a copolymer of isobutylene and butadiene; or a copolymer of ethylene, propylene and 1,4-hexadiene; etc.

In some cases, the olefin polymer may be completely saturated, e.g., an ethylene-propylene copolymer made by a Ziegler-Natta synthesis using hydrogen as a moderator to control molecular weight. In this case the alpha- or beta-unsaturated dicarboxylic acid anhydride is reacted with the saturated ethylene-propylene copolymer utilizing a radical initiator.

The long chain hydrocarbyl substituted dicarboxylic acid producing material, e.g.; acid or anhydride used in the invention includes a long chain hydrocarbon, generally a polyolefin, substituted typically with an average of at least about 0.8 per mole of polyolefin, of an alpha- or beta-unsaturated ($C_4$-$C_{10}$) dicarboxylic acid, anhydride or ester thereof, such as fumaric acid, itaconic acid, maleic acid, maleic anhydride, chloromaleic acid, dimethylfumarate, chloromaleic anhydride, acrylic acid methacrylic acid, crotonic acid, cinnamic acid, and mixtures thereof.

The alkenyl succinic acid anhydride may be characterized by the following formula

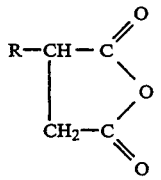

In the above formula, R may be a residue (containing residual unsaturation) from a polyolefin which was reacted with maleic acid anhydride to form the alkenylsuccinic acid anhydride. $R^5$ may have a number average molecular weight (Mn) ranging from about 500–10,000, preferably about 1000–5000, and more preferably from about 2000–2500.

The polyamine composition which may be employed in practicing the present invention may include primary and/or secondary amines. The amines may typically be characterized by the formula

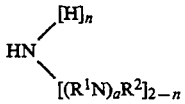

In this formula, a may be an integer of about 3 to about 8, preferably about 5; and n may be 0 or 1. In the above compound, $R^2$ may be hydrogen or a hydrocarbon group selected from the group consisting of alkyl, aralkyl, cycloalkyl, aryl, alkaryl, alkenyl, and alkynyl, including such radicals when inertly substituted. The preferred $R^2$ groups may be hydrogen or lower alkyl group, i.e. ($C_1$-$C_{10}$) alkyl, groups including e.g. methyl, ethyl, n-propyl, i-propyl, butyls, amyls, hexyls, octyls, decyls, etc. $R^1$ may preferably be hydrogen. $R^1$ may be a hydrocarbon selected from the same group as $R^2$ subject to the fact that $R^1$ is divalent and contains one less hydrogen. Preferably $R^2$ is hydrogen and $R^1$ is $—CH_2CH_2—$. Typical amines which may be employed may include those listed below in Table 1.

TABLE 1 diethylenetriamine (DETA)

triethylenetetramine (TETA)

tetraethylenepentamine (TEPA)

pentaethylenehexamine (PEHA)

The bis(hydroxyaromatic) substituted carboxylic acid is represented by the formula:

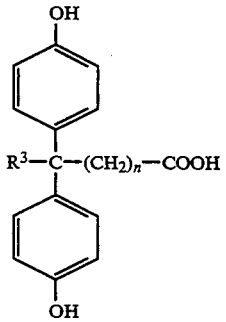

in which $R^3$ is H or a branched or straight chain radical having 0 to 24 carbon atoms that can be alkyl, alkenyl, alkoxyl, aralkyl, alkaryl in which n has a value from 0 to 10. The $(CH_2)_n$ grouping may also be substituted with an alkyl, alkenyl, alkoxyl, aralkyl or alkaryl group.

According to the present invention, these bis(hydroxyaromatic) substituted carboxylic acids are used as an acylating agent. It is a feature of these bis(hydroxyaromatic) substituted carboxylic acids that they contain two phenolic groups. The rings on which the hydroxyaromatic groups are situated may bear substituents wherein the phenyl rings are optionally substituted. The preferred hydroxyaromatic substituted carboxylic acid is 4,4-bis(4-hydroxyphenyl)valeric acid. The other acylating agent that may optionally be used with the carboxylic acid, is selected from the group consisting of hydroxyaliphatic acid that contains from 1 to 4 carbon atoms exclusive of the carboxyl group. The preferred hydroxy- aliphatic acid is glycolic acid. The acylated mono- and/or bis-succinimide may be reacted with a borating agent. The borating agent is selected from the group consisting of boric acid, boron oxide, boron halide, and a boron acid ester, to provide a borated derivative thereof.

The lubricating oil of the present invention contains the additive reaction product in a concentration ranging from about 0.1 to 30 weight percent. A concentration range for the additive ranging from about 0.5 to 15 weight percent based on the total weight of the oil composition is preferred with a still more preferred concentration range being from about 1 to 8.0 weight percent.

Oil concentrates of the additives may contain from about 1 to 75 weight percent of the additive reaction product in a carrier or diluent oil of lubricating oil viscosity.

The novel reaction product of the invention may be employed in lubricant compositions together with conventional lubricant additives. Such additives may include additional disperants, detergents, antioxidants, pour point depressants, anti-wear agents and the like.

The novel additive reaction product of the invention was tested for its effectiveness as a dispersant and as an antioxidant in a fully formulated lubricating oil composition.

The acylating agent may be a carboxylic acid such as a hydroxyaliphatic acid or a fatty acid. The suitable fatty acids are straight chain compounds, ranging from 3 to 18 carbons. They may be saturated or unsaturated. Saturated acids include lauric, myristic, pentadecanoic, palmitic, margaric and stearic. Unsaturated acids include myristoleic, palmitoleic, oleic, linoleic and linolenic.

The hydroxyaliphatic acid preferably used as an acylating agent is a carboxylic acid characterized by the formula HO—$R^4$—COOH, wherein $R^4$ is an alkyl group having from 1 to about 4 carbon atoms and the hydroxyl group can be located at any available position therein.

The preferred acylating agents are glycolic acid, lactic acid, 2-hydroxymethylpropionic acid, and 2,2-bis(hydroxymethyl) propionic acid, the most preferred being glycolic acid.

It is understood that equivalents of the carboxylic acids prescribed, namely their anhydrides, esters and acyl halides, can also be employed in the practice of this invention. A characteristic of the preferred $C_2$ and $C_3$ hydroxyaliphatic carboxylic acids is their relatively limited or negligible solubility in mineral oil.

The novel reaction product of the invention may be employed in lubricant compositions together with conventional lubricant additives. Such additives may include additional dispersants, detergents, antioxidants, pour point depressants, anti-wear agents and the like.

The novel additive reaction product of the invention was tested for its effectiveness as a dispersant and as an antioxidant in a fully formulated lubricating oil composition.

According to the present invention, the acylated mono-and/or bis-alkenyl succinimide may also be borated with a boron-containing compound to form a borated acylated mono- and/or bis-alkenyl succinimide.

The borating agent, i.e., boron containing compound, is selected from the group consisting of boric acid, boron oxide, boron halide and a boron acid ester, to provide a borated derivative thereof.

The preferred borating agent is boric acid.

EXAMPLES

The above process and products are illustrated in the Examples below and by reviewing such Examples the present invention and its advantages will be more apparent.

Example 1

Preparation of Acylated Mono-and/or Bis-Alkenylsuccinimide Dispersant Containing Bisphenolic Groups A mixture of polyisobutenylsuccinic acid anhydride (PIBSA) (2000.0 g,0.522 moles) and pentaethylenehexamine (76.4 g, 0.288 moles) was charged into a five liter 3-neck flask equipped with a mechanical stirrer, thermometer, thermocouple, and nitrogen inlet and heated at 130° C. for 3.0 hours. (The PIBSA used was prepared from an approximately 2150 mol. wt. polyisobutene.)

Then the reaction mixture was cooled to below 90° C. and 4,4-bis(4-hydroxyphenyl)valeric acid (99.8 g, 0.349 moles) and 70% aqueous glycolic acid (75.9 g, 0.703 moles) were added with stirring and the mixture was heated at 160° C. for 5.0 hours while passing nitrogen through the mixture. Then diluent oil (1601 g) was added to yield an approximately 50% concentrate. It analyzed as follows: % N=0.72, Total Acid Number (TAN)=3.8, Total Base Number (TBN)=9.6.

Example 2 (SCALE-UP)

Preparation of Acylated Mono- and/or Bis-Alkenylsuccinimide Dispersant Containing Bisphenolic Groups Polyisobutenylsuccinic acid anhydride (300 lbs, 0.082 lb-moles, PIBSA prepared from an approximately 2150 mol. wt. polybutene) was charged into a 100-gallon carbon steel reactor equipped with a mechanical stirrer, thermocouple, and nitrogen inlet and heated to 60° C. Next, pentaethylenehexamine (11.7 lbs, 1.5 lb-moles) was added and the heat was increased to 120° C. and maintained for 2.0 hours and heated at 130° C. for 3.0 hours. (The PIBSA used was prepared from an approximately 2150 mol. wt. polyisobutene.)

Then, 4,4-bis(4-hydroxyphenyl)valeric acid (15.4 lb, 0.054 lb-moles) and 70% aqueous glycolic acid (11.6 lb, 0.107 lb-moles) were added and the mixture was heated at 160° C. for 6.0 hours. The product was blended with diluent oil (253.3 lb) to yield an approximately 50% concentrate. It analyzed as follows: % N=0.67, Total Acid Number (TAN)=3.3, Total Base Number (TBN)=9.5.

Example 3 (USING LESS BISPHENOLIC COMPOUND)

Preparation of Acylated Mono- and/or Bis-Alkenylsuccinimide Dispersant Containing Bisphenolic Groups This example is similar to the first example except that the amount of bisphenolic compound (4,4-bis(4-hydroxyphenyl)valeric acid) is decreased to one-half the relative amount used in Example 1.

A mixture of polyisobutenylsuccinic acid anhydride (PIBSA) (2000.0 g, 0.540 moles) and pentaethylenehexamine (78.7 g, 0.297 moles) was charged into a five-liter, 3-neck flask equipped with a mechanical stirrer, thermometer, thermocouple, and nitrogen inlet and heated at 130° C. for 3.0 hours. (The PIBSA used was prepared from an approximately 2150 mol. wt. polyisobutene.)

Then the reaction mixture was cooled to below 90° C. and 4,4-bis(4-hydroxyphenyl)valeric acid (51.0 g, 0.178 moles) and 70% aqueous glycolic acid (78.0 g, 0.718 moles) were added with stirring and the mixture was heated at 160° C. for 5.0 hours while passing nitrogen through the mixture. Then, diluent oil (1630 g) was added to yield an approximately 50% concentrate. It analyzed as follows: % N=0.70, Total Acid Number (TAN)=4.3, Total Base Number (TBN)=9.1.

Example 4 (COMPARATIVE)

Preparation of Acylated Mannich Hydroxyaromatic-Amine Coupled Mono- and/or Bis-Alkenylsuccinimide Dispersant Polyisobutenylsuccinic acid anhydride (2000 lbs, 0.550 lb-moles, PIBSA prepared from an approximately 2150 mol. wt. polybutene) was charged into a 500 gal carbon steel reactor equipped with a mechanical stirrer, thermocouple, and nitrogen inlet and heated to 60° C. Next tetraethylenepentamine (57.4 lbs, 0.303 lb-moles) was added and the heat was increased to 120° C. and maintained for 2.0 hours. Then 4-hydroxydiphenylamine as a 40% solution in Surfonic N40 (67.0 lbs, 0.145 lb-moles) was added, followed by a 37% solution of formaldehyde (49.3 lbs, 0.608 lb-moles). The temperature was maintained at 120° C. for 0.5 hours. Next a 70% solution of glycolic acid (88.8 lbs, 0.818 lb-moles) was added and the temperature was raised to 160° C. and then maintained for 4 hours to drive off water.

Pale oil (1000 lbs) was added to the product and the hot mixture (~100° C.) was filtered through diatomaceous earth filter aid. to yield an approximately 50% concentrate. It analyzed as follows: % N=0.79, Total Acid Number (TAN)=5.3, Total Base Number (TBN)=11.7.

SEQUENCE VE GASOLINE ENGINE TEST RESULTS

The ASTM Sequence VE gasoline engine test is used to evaluate the performance of gasoline engine oils in protecting engine parts from sludge and varnish deposits and valve train wear due to low temperature "stop and go" operation. The test uses a Ford 2.3 L four-cylinder Ranger truck engine. The engine is cycled through three test stages, requiring four hours to complete, for 288 hours or 72 cycles. The Sequence VE gasoline engine test results shown below in Tables 2, 3, 4, and 5 were run in a fully formulated multigrade and single grade motor oils. Each grade of oil contained the same components and base oils except for the dispersant. For each grade of oil, one blend contained the dispersant from Example 1 or 2 (new dispersant) and the other the dispersant from Example 4 (present dispersant). Even though the oils containing the dispersant from Example 1 or Example 2 contained less dispersant than the oils containing the dispersant from Example 4, they always showed superior or similar engine test results.

TABLE 2

Sequence VE Gasoline Engine Test Results In SAE 10W-40 Fully Formulated Motor Oil

| Dispersant from Example | 1 | 4 | Limits |
|---|---|---|---|
| Dispersant Dosage, wt % | 4.3 | 5.7 | |
| Avg Sludge | 9.51 | 9.24 | 9.0 min |
| Avg Varnish | 5.93 | 5.23 | 5.0 min |
| Piston Skirt Varnish | 7.01 | 6.56 | 6.5 min |
| Rocker Arm Cover Sludge | 9.46 | 9.17 | 7.0 min |
| Max. Cam Lobe Wear, mils | 8.5 | 2.6 | 15 max |
| Avg. Cam Lobe Wear, mils | 4.0 | 1.65 | 5 max |
| Oil screen Clogging, % | 0 | 0 | 20.0 max |

TABLE 3

Sequence VE Gasoline Engine Test Results In SAE 30W Fully Formulated Motor Oil

| Dispersant from Example | 1 | 4 | Limits |
|---|---|---|---|
| Dispersant Dosage, wt % | 5.0 | 5.9 | |
| Avg Sludge | 9.19 | 9.18 | 9.0 min |
| Avg Varnish | 5.30 | 5.31 | 5.0 min |
| Piston Skirt Varnish | 6.88 | 6.90 | 6.5 min |
| Rocker Arm Cover Sludge | 9.14 | 8.84 | 7.0 min |
| Max. Cam Lobe Wear, mils | 4.80 | 2.10 | 15 max |
| Avg. Cam Lobe Wear, mils | 2.40 | 1.45 | 5 max |
| Oil screen Clogging, % | 4 | 0 | 20.0 max |

TABLE 4

Sequence VE Gasoline Engine Test Results In SAE 15W-40 Fully Formulated Motor Oil

| Dispersant from Example | 1 | 4 | Limits |
|---|---|---|---|
| Dispersant Dosage, wt % | 3.3 | 4.7 | |
| Avg Sludge | 9.10 | 7.39 | 9.0 min |
| Avg Varnish | 3.94 | 4.40 | 5.0 min |
| Piston Skirt Varnish | 6.40 | 6.92 | 6.5 min |
| Rocker Arm Cover Sludge | 8.75 | 7.39 | 7.0 min |
| Max. Cam Lobe Wear, mils | 6.50 | 4.40 | 15 max |
| Avg. Cam Lobe Wear, mils | 1.90 | 2.15 | 5 max |
| Oil screen Clogging, % | 0 | 1.0 | 20.0 max |

TABLE 5

Sequence VE Gasoline Engine Test Results in SAE 10W-30 Fully Formulated Motor Oil

| Dispersant from Example | 2 | 4 | Limits |
|---|---|---|---|
| Dispersant Dosage, wt % | 5.0 | 5.7 | |
| Avg Sludge | 9.10 | 9.24 | 9.0 min |
| Avg Varnish | 6.37 | 5.47 | 5.0 min |
| Piston Skirt Varnish | 7.14 | 6.68 | 6.5 min |
| Rocker Arm Cover Sludge | 9.20 | 8.96 | 7.0 min |
| Max. Cam Lobe Wear, mils | 11.40 | 9.80 | 15 max |
| Avg. Cam Lobe Wear, mils | 4.95 | 2.43 | 5 max |
| Oil Screen Clogging, % | 0 | 0 | 20.0 max |

NEW YORK CITY TAXI ENGINE OIL TEST

The purpose of this test is to evaluate the performance of engine oils in taxi service and to provide data required for additive and product development and marketing support.

The oils are being tested in the 1993 model Ford Crown Victorias with the 4.6L modular engines. Oil changes are being done every 21 days. The results of intermediate inspections on the engines at 30,000 miles are summarized in Table ATS 1–5.

Oil #A87 contains the dispersant described in Example 2 and shows the best sludge and varnish performance of all the oils tested. The results support the superior dispersancy performance of dispersants containing bisphenolic groups under actual driving conditions.

TABLE ATS-1.5
NYC TAXI ENGINE OIL TEST
INTERMEDIATE (30,000) MILE) INSPECTION RESULTS

| OIL# | VIS GRADE | BASE OIL | DI PACK | VII | # INSP. | AVG. DRAIN MILES | % VIS INC. @ 100° C. | DEPOSITS SLUDGE* | DEPOSITS VARNISH* |
|---|---|---|---|---|---|---|---|---|---|
| A83 | 5W-30 | AB1 | AD11 | AV11 | 3 | 4696 | 3.21 | 8.93 | 8.54 |
| A84 | 5W-30 | AB1 | AD12 | AV11 | 3 | 4622 | 7.32 | 9.14 | 7.47 |
| A87 | 5W-30 | AB1 | AD12' | AV11 | 3 | 4745 | 5.80 | 9.18 | 9.12 |
| A88 | 5W-30 | AB1 | AD12" | AV11 | 3 | 4720 | 9.52 | 8.95 | 7.55 |
| A89 | 5W-30 | AB1 | AD11 | AV12 | 3 | 4847 | 9.04 | 8.81 | 8.31 |
| A90 | 5W-30 | AB1 | AD11 | AV13 | 3 | 4810 | 15.62 | 8.78 | 8.31 |
| A91 | 10W-30 | AB3' | AD14 | AV16 | 3 | 4909 | 12.65 | 8.44 | 7.52 |
| A92 | 5W-30 | AB3 | AD13 | AV15 | 3 | 4724 | 8.71 | 8.62 | 8.00 |
| A93 | 10W-30 | ABS | AD15 | AV15 | 3 | 4899 | 13.39 | 8.69 | 8.07 |
| A94 | 10W-40 | AB4 | AD15 | AV17 | 3 | 5083 | 38.52 | 8.49 | 7.59 |
| A95 | 10W-30 | AB2 | AD15 | AV15 | 3 | 4748 | 12.02 | 8.84 | 8.07 |

*A rating of 10 is completely clean.
The higher the rating the better.

BENCH SLUDGE TEST

This test is conducted by heating the test oil mixed with synthetic hydrocarbon blowby and a diluent oil at a fixed temperature for a fixed time period. After heating, the turbidity of the resulting mixture is measured. A low percentage turbidity (20–40) is indicative of good dispersancy while a high value (40 to 200) is indicative of an oil's increasingly poor dispersancy. The results obtained with the known and present dispersants are set forth below in Table 6 in a SAE 10W-40 fully formulated motor oil. Again, the oil containing the new dispersant showed superior results at much lower dosages.

TABLE 6

Bench Sludge Test Results

| Dispersant Used | Rating |
|---|---|
| Example 1 at 4.3% | 19 |
| Example 2 at 5.7% | 37 |
| Reference (SG) | 30 |
| Reference (good) | 34 |
| Reference (fair) | 54 |
| Reference (poor) | 70 |

SEAL COMPATIBILITY TEST RESULTS

The results in Table 6, below, show the superiority of the dispersant from Example 1 in providing protection against the deterioration of fluorocarbon rubber engine seals as measured in the Mercedes-Benz Viton Seal Compatibility Test.

THE MERCEDES-BENZ VITON COMPATIBILITY TEST

An important property of a lubricating oil additive and a blended lubricating oil composition containing additives is the compatibility of the oil composition with the rubber seals employed in the engine. Nitrogen containing succinimide dispersants employed in crankcase lubricating oil compositions have the effect of seriously degrading the rubber seals in internal combustion engines. In particular, such dispersants are known to attack Viton AK-6 rubber seals which are commonly employed in internal combustion engines. This deterioration exhibits itself by sharply degrading the flexibility of the seals and in increasing their hardness. This is such a critical problem that the Mercedes-Benz Corporation requires that all crankcase lubricating oils must pass a Viton Seal Compatibility Test before the oil composition will be rated acceptable for engine crankcase service.

This test method is based on the Mercedes-Benz VDA 521-01 Fluorohydrocarbon Seal Compatibility Test; ASTM D 412 Standard Test, Rubber Properties in Tension; ASTM D 471 Standard Test Method for Rubber Property, Effect of Liquids; and ASTM D 2240 Standard Test Method for Rubber Property, Durometer Hardness.

The Viton Seal Compatibility Test is conducted by soaking a sample of Viton AK-6 rubber at an elevated temperature in the oil being tested and then testing the rubber sample for volume change, elongation change, hardness change, and tensile strength.

The specific procedure involves cutting three 25.4 mm by 50.8 mm specimens for each test oil from a sheet of elastomer. A small hole is punched in one end of each specimen. Each specimen is weighed in air and in water to the nearest mg. After weighing in water, each specimen is dipped in alcohol and let dry on clean filter paper. The hardness of the specimens is determined with a durometer. The three specimens are stacked on the top of each other and five hardness measurements made at least 6.4 mm apart. The average of the five measurements is the hardness value.

The three specimens are suspended in a graduated cylinder by inserting a piece of nichrome wire through the small hole in the end of each specimen. The specimens are arranged so that they do not touch each other or the sides of the cylinder. 200 ml of test oil are poured into the cylinder. The cylinder opening is sealed with an aluminum foil covered cork. The cylinder is aged for 168 hours in an oven maintained at 150° C.±1° C.

Six dumbbell specimens are cut from a sheet of elastomer and the elongation and tensile strength of three of the specimens measured.

The remaining three specimens are suspended in a graduated cylinder by inserting a piece of nichrome wire through a small hole punched in one end of each specimen. 200 ml of test oil are poured into the cylinder. The cylinder is stoppered with an aluminum foil covered cork and aged for 168 hours in an oven maintained at 150° C.±1° C.

At the end of the test period, the cylinders are removed from the oven and the specimens transferred to fresh portions of the test fluid and let cool for 30–60 minutes. The specimens are removed from the cylinder, rinsed with ethyl ether, and air dried. Elongation and tensile strength measurements are made on each dumbbell specimen. Each rectangular specimen is weighed in air and in water and measured for hardness.

The results of the Mercedes-Benz test runs are provided below in Table 7.

TABLE 7

MERCEDES-BENZ SEAL COMPATIBILITY TEST RESULTS IN FULLY FORMULATED 10W-40 OIL

| | | *AK-6 (Fluorocarbon Rubber) (Change at-Break) | |
|---|---|---|---|
| | Dispersant Dosage | % Tensile Strength | % Mechanical Elongation |
| Example 1 Dispersant | 4.3% | −19.6 | −8.6 |
| Example 2 Dispersant | 5.7% | −30.5 | −28 |
| LIMITS: | | MAX −40 | MAX −45 |

*AK-6 - Fluorocarbon Test Rubber manufactured and sold by Parker-Prädifa GmbH of Bietighem-Bissingen, Germany.

We claim:

1. A lubricating oil composition comprising
(1) a major portion of a lubricating oil, and
(2) a minor portion of an antioxidant-dispersant lubricating additive prepared by the process comprising:
(a) reacting a polyethyleneamine with an alkenylsuccinic acid anhydride to form a mono- and/or bis-alkenylsuccinimide;
(b) acylating said mono- and/or bis-alkenylsuccinimide with a bis(hydroxyaromatic) substituted carboxylic acid of the formula

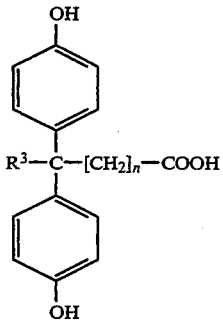

in which $R^3$ is H or selected from alkyl, alkenyl, alkoxyl, aralkyl or alkaryl having 1 to 24 carbon atoms, wherein the group $(CH_2)_n$ may be substituted with an alkyl, alkenyl, alkoxyl, aralkyl or alkaryl group; and, optionally, another acylating agent to form an acylated mono- and/or bis-alkenylsuccinimide; and
(c) recovering said acylated mono- and/or bis-alkenylsuccinimide.

2. The lubricating oil composition of claim 1, wherein said bis(hydroxyaromatic) substituted carboxylic acid is 4,4-bis(4-hydroxyphenyl)valeric acid.

3. The lubricating oil composition of claim 1, wherein said optional acylating agent is selected from the group consisting of glycolic acid, lactic acid, a $(C_1-C_4)$ hydroxyaliphatic acid, a 2-hydroxymethylpropionic acid and 2, 2-bis(hydroxymethyl) propionic acid.

4. The lubricating oil composition of claim 3, wherein said optional acylating agent, is glycolic acid.

5. The lubricating oil composition of claim 1, wherein said bis(hydroxyaromatic) substituted carboxylic acid is represented by the formula

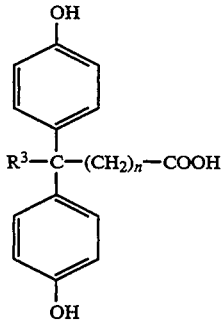

in which $R^3$ is H or a $(C_1-C_{24})$ branched or straight chain radical, and n has a value of 0 to 10.

6. A lubricating oil composition comprising
(1) a major portion of a lubricating oil, and
(2) a minor portion of an antioxidant-dispersant lubricating additive prepared by the process comprising:
(a) reacting a polyethyleneamine with an alkenylsuccinic acid anhydride to form a mono- and/or bis-alkenylsuccinimide;
(b) acylating said mono- and/or bis-alkenylsuccinimide with a bis(hydroxyaromatic) substituted carboxylic acid of the formula

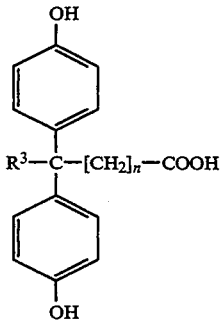

in which $R^3$ is H or selected from alkyl, alkenyl, alkoxyl, aralkyl or alkaryl having 1 to 24 carbon atoms, wherein the group $(CH_2)_n$ may be substituted with an alkyl, alkenyl, alkoxyl, aralkyl or alkaryl group; and, optionally, another acylating agent to form an acylated mono- and/or bis-alkenylsuccinimide; and
(c) borating said acylated mono- and/or bis-alkenylsuccinimide with a boron-containing compound to form a borated acylated mono- and/or bis-alkenyl succinimide; and
(d) recovering said borated acylated mono- and/or bis-alkenylsuccinimide.

7. The lubricating oil composition of claim 6, wherein said boron containing compound is selected from the group consisting of boric acid, boron oxide, boron halide and a boron acid ester.

8. The lubricating oil composition of claim 7, wherein said boron containing compound is boric acid.

* * * * *